US010737293B2

(12) United States Patent
Satou et al.

(10) Patent No.: US 10,737,293 B2
(45) **Date of Patent: *Aug. 11, 2020**

(54) PRETREATMENT METHOD FOR COATING OR PRINTING

(71) Applicant: NISSHIN STEEL CO., LTD., Tokyo (JP)

(72) Inventors: Masaki Satou, Tokyo (JP); Seiju Suzuki, Tokyo (JP); Masaru Hiraku, Tokyo (JP); Shuichi Sugita, Tokyo (JP)

(73) Assignee: NISSHIN STEEL CO., LTD., Tokyo (JP)

( * ) Notice: Subject to any disclaimer, the term of this patent is extended or adjusted under 35 U.S.C. 154(b) by 14 days.

This patent is subject to a terminal disclaimer.

(21) Appl. No.: 15/577,367

(22) PCT Filed: Jun. 8, 2016

(86) PCT No.: PCT/JP2016/067028

§ 371 (c)(1),
(2) Date: Nov. 28, 2017

(87) PCT Pub. No.: WO2016/199802

PCT Pub. Date: Dec. 15, 2016

(65) Prior Publication Data

US 2018/0154391 A1 Jun. 7, 2018

(30) Foreign Application Priority Data

Jun. 8, 2015 (JP) ..... 2015-116011
Dec. 28, 2015 (WO) ..... PCT/JP2015/086521

(51) Int. Cl.
*B05D 3/08* (2006.01)
*B05D 7/14* (2006.01)
(Continued)

(52) U.S. Cl.
CPC ..... *B05D 3/08* (2013.01); *B05D 7/14* (2013.01); *B05D 7/24* (2013.01); *B41M 5/0011* (2013.01);
(Continued)

(58) Field of Classification Search
None
See application file for complete search history.

(56) References Cited

U.S. PATENT DOCUMENTS 5,919,517 A * 7/1999 Levendusky ..... B05D 1/265 156/229
2003/0031859 A1* 2/2003 Sinsel ..... B05D 1/265 428/332
2010/0127271 A1* 5/2010 Daniel ..... H01L 27/283 257/72

FOREIGN PATENT DOCUMENTS

JP 7-243070 9/1995
JP 11-90313 4/1999
JP 2007-191745 8/2007

OTHER PUBLICATIONS

International Search Report dated Aug. 9, 2016 in International (PCT) Application No. PCT/JP2016/067028.

* cited by examiner

*Primary Examiner* — Shamim Ahmed
*Assistant Examiner* — Bradford M Gates
(74) *Attorney, Agent, or Firm* — Wenderoth, Lind & Ponack, L.L.P.

(57) ABSTRACT

A method for treating a metal substrate surface before coating or printing thereof, the method including preheating to 40° C. or above a specific metal substrate having a thermal conductivity of 10 W/mK or higher, and thereafter
(Continued)

performing a flame treatment on the substrate surface, prior to coating or printing of the surface of the substrate with a coating material or an ink.

9 Claims, 1 Drawing Sheet

(51) Int. Cl.

| | |
|---|---|
| ***C23C 26/00*** | (2006.01) |
| ***C23G 5/00*** | (2006.01) |
| ***B41M 5/00*** | (2006.01) |
| ***B05D 7/24*** | (2006.01) |
| *B41M 5/52* | (2006.01) |
| *B05C 9/14* | (2006.01) |

(52) U.S. Cl.
CPC ..... *B41M 5/0047* (2013.01); *B41M 5/0058* (2013.01); *C23C 26/00* (2013.01); *C23G 5/00* (2013.01); *B05C 9/14* (2013.01); *B41M 5/52* (2013.01); *B41M 5/5272* (2013.01)

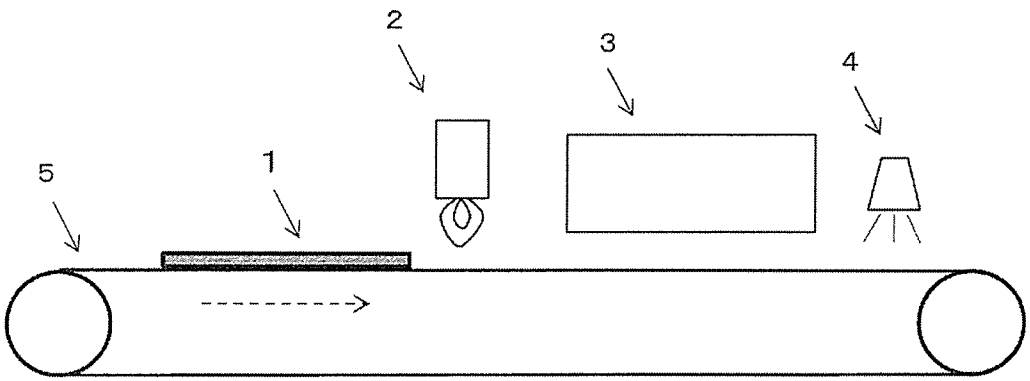
1
2
3
4
5

PRETREATMENT METHOD FOR COATING OR PRINTING

TECHNICAL FIELD

The present invention relates to a pretreatment method that is performed on the surface of a metal substrate having specific characteristics (having a thermal conductivity of 10 W/mK or higher), during coating or printing using a coating material or ink containing a resin.

BACKGROUND ART

The added value of metal substrates has conventionally been increased through enhancement of the functionality and designability of the substrate using a coating material or ink that contains a resin. Technical developments in recent years have spurred the demand for higher functionality and design diversity, and for coating and printing technology with high precision.

The presence of foreign matter such as dust and dirt on the surface of a substrate prior to coating or printing of the substrate surface gives rise, in coating material and inks, to a drop in wettability and in adhesion to the substrate, which precludes achieving satisfactory coating or printing.

PTL 1 discloses a method for accelerating curing of an outer-surface coating agent, the method involving removing for instance water, dust, oils and the like adhered to the surface of a steel pipe, using a burner flame, and thereafter, coating the steel pipe with a coating agent once the temperature of the steel pipe has been brought to 50° C. to 70° C.

The surface of steel pipes is in general sufficiently coated with anti-rust oil. In order to burn anti-rust oil off, heating is required at a temperature of 400° C. or above, for a given lapse of time. This may give rise to the problem of impaired quality, as an article, due for instance to oxidation of the metal surface. Accordingly, means such as alkali degreasing are ordinarily resorted to in order to remove oils, such as anti-rust oil, that are adhered to the metal surface, while removal of oils on the metal surface by burning is generally not resorted to.

PTL 2 discloses a method in which oils or solid deposits having become adhered, during a production process, on the surface of a metal strip such as a stainless steel strip or an alloy strip, are washed using a washing liquid such as an organic solvent or an alkaline solution, followed by cleaning of the surface by a flame treatment.

Although no foreign matter is present on the surface of the metal strip immediately after such degreasing and cleaning, foreign matter such as floating dust or dirt in the storage site becomes deposited during storage over the course of several hours to several days. Such foreign matter must thus be removed when performing high-precision coating or printing.

In a plated steel sheet such as a hot-dip Zn-55% Al alloy plated steel sheet, the plating surface immediately after plating is clean, and accordingly a coating material or printing ink is in sufficient close contact with the surface. Over the course of several hours or several days after plating, however, very fine organic dirt becomes adhered to the metal surface. This is problematic in that the coating material or printing ink fails to be in sufficient close contact with the surface.

In the production process of the coated steel sheet, a coating film may in some instances adhere partially to a device for producing the coated steel sheet, when the coated steel sheet comes in contact with the device. When this deposit adheres to a coated steel sheet of a subsequent load, the deposit constitutes foreign matter of that subsequent-load coated steel sheet.

CITATION LIST

Patent Literature

[PTL 1] Japanese Patent Application Publication No. H11-90313

[PTL 2] Japanese Patent Application Publication No. H07-243070

SUMMARY OF INVENTION

Technical Problem

The inventors had studied the approach of burning off, through a flame treatment, foreign matter adhered to the surface of a metal substrate, prior to coating or printing of the metal substrate with a coating material or with an ink, but found that adhesion and wettability of the coating film or printing ink after the treatment are insufficient in a case where a simple flame treatment is carried out.

Further studies by the inventors have revealed that condensation generated during the flame treatment is one cause that underlies drops in adhesion and wettability of the coating film or the printing ink, and that such condensation is a phenomenon specific to metal substrates of high thermal conductivity.

The inventors studied methods for preventing condensation generated during the flame treatment, and found as a result that the adhesion and wettability of the coating film or printing ink can be enhanced by preheating the metal substrate to a temperature of 40° C. or above before the flame treatment.

Solution to Problem

Therefore, the present invention provides a method for treating a metal substrate surface before coating or printing thereof, the method involving: preheating to 40° C. or above a metal substrate having a thermal conductivity of 10 W/mK or higher and selected from among plated steel sheet, stainless steel sheet, coated steel sheet, aluminum sheet, copper sheet and degreased ordinary steel sheet, and thereafter performing a flame treatment on the substrate surface, prior to coating or printing of the surface of the substrate with a coating material or an ink.

Advantageous Effects of Invention

Burners that utilize liquefied petroleum gas (LPG) and liquefied natural gas (LNG) as fuel are generally used in flame treatments. During combustion of, for instance, liquefied petroleum gas there occur chemical reactions such as those in the chemical formula below.

$$C_3H_8(LPG)+5O_2 \rightarrow 3CO_2+4H_2O+heat$$

When the metal substrate with high thermal conductivity used in the present invention is subjected, without preheating, to a flame treatment by a burner, heat dissipates quickly at the moment where flames come in contact with the metal substrate, and the temperature of the concerned site drops accordingly. As a result, moisture present in the form of water vapor in the flame cools down on the substrate surface and condenses on the surface of the metal substrate. This condensation water hinders the flame treatment by remaining on the substrate surface during the flame treatment.

Therefore, by preheating to 40° C. or above the metal substrate having a specific thermal conductivity, during the flame treatment, it becomes possible to suppress the occurrence of condensation, to remove foreign matter adhered to the metal substrate surface, and to increase the adhesion and wettability of a coating film or a printing ink.

BRIEF DESCRIPTION OF DRAWINGS

FIG. 1 is a diagram illustrating an embodiment of the present invention.

DESCRIPTION OF EMBODIMENTS

The present invention utilizes a metal substrate having a thermal conductivity of 10 W/mK or higher, for coating or printing with a coating material or an ink. Preferably there is used a substrate having a thermal conductivity of 15 W/mK or higher, more preferably of 30 W/mK or higher and most preferably of 40 W/mK or higher.

When thermal conductivity is lower than 10 W/mK, the thermal diffusion of the substrate is low, and accordingly preheating is not necessary, since no condensation occurs even if water vapor in the flame comes in contact with the substrate.

As described above, the thermal conductivity of the metal substrate of the present invention is 10 W/mK or higher. A plated steel sheet such as a hot-dip Zn-55% Al alloy plated steel sheet, a stainless steel sheet, an aluminum sheet, a copper sheet and a degreased ordinary steel sheet can be used as the metal substrate that is utilized in the present invention. The term aluminum sheet encompasses aluminum alloys having aluminum as a main constituent.

Impairment of quality due to oxidation at normal temperatures need not be addressed in plated steel sheets, stainless steel sheets, aluminum sheets and copper sheets, and hence the foregoing are not coated with an oil such as an anti-rust oil. For instance oils such as lubricating oils and rolling oils may in some instances be applied, in the production line, on stainless steel sheets, but the surface is ultimately cleaned in a washing step. Plated steel sheets are ultimately subjected to a surface treatment, and hence do not rust readily. The surface of aluminum sheets becomes immediately covered with aluminum oxide, which prevents further oxidation, and accordingly the quality of aluminum sheets is not impaired by rusting. Copper sheets are less prone to rusting than iron, and need not be coated with an anti-rust oil or the like.

By contrast, ordinary steel sheets are prone to rusting during storage, and are accordingly coated with anti-rust oil. When an ordinary steel sheet is to be used in the treatment method of the present invention, the ordinary steel sheet that is used is subjected to a degreasing treatment. Degreasing can be accomplished in accordance with a known degreasing treatment such as an alkali treatment or a solvent treatment.

In terms of the coating apparatus or printing apparatus, the metal substrates that are used in the present invention are preferably of elongate rectangular shape.

These metal substrates may be worked through embossing, draw forming and the like, so as to have an uneven texture with tile, brick or wood grain patterns.

A chemical conversion coating film may be formed on the surface of the metal substrate. The chemical conversion coating film is formed on the entire surface of the substrate, to increase the corrosion resistance of the substrate. The type of the chemical conversion treatment for forming the chemical conversion coating film is not particularly limited. Examples of chemical conversion treatments include for instance chromate treatments, chromium-free treatments and phosphate treatments. The deposition amount of the chemical conversion coating film is not particularly limited, so long as it lies within a range that is effective in terms of enhancing corrosion resistance.

The metal substrate used in the present invention also encompasses a coated steel sheet in which a coating film derived from a coating material is provided on one or both faces of the above steel sheets.

The coated steel sheet as the metal substrate of the present invention is obtained by arbitrarily forming a chemical conversion coating film and/or undercoat film on the above steel sheets, followed by formation of an ink-receiving layer.

The chemical conversion coating film is formed on the entire surface of the steel sheet, to enhance coating film adhesion and corrosion resistance. Examples of chemical conversion treatments are as described above.

The undercoat film is formed on the surface of the steel sheet or the chemical conversion coating film, to increase coating film adhesion and corrosion resistance. For instance, the undercoat film is formed by coating the surface of a steel sheet or a chemical conversion coating film with an undercoat material that contains a resin, and by drying (or curing) the undercoat material. The type of resin contained in the undercoat material is not particularly limited. Examples of resin types include for instance polyesters, epoxy resins, acrylic resins and the like. Epoxy resins have high polarity and exhibit good adhesion, and are therefore particularly preferred herein. The thickness of the undercoat film is not particularly limited, so long as the above function can be brought out. The thickness of the undercoat film is for instance about 5 μm.

The ink-receiving layer of the coated steel sheet that is used in the present invention is formed using a coating material in the form of a resin composition that contains a pigment and a resin for forming a matrix.

The type of resin that yields the matrix is not particularly limited. Examples of matrix-forming resins include for instance polyesters, acrylic resins, polyvinylidene fluoride, polyurethane, epoxy resins, polyvinyl alcohol, and phenolic resins. The matrix-forming resin is preferably a polyester, an acrylic resin or polyvinylidene fluoride, from the viewpoint of adhesion towards inks.

When using a polyester resin for forming a matrix, the resin composition that is utilized in that case has for instance a polyester, a melamine resin, a catalyst and an amine.

The type of polyester is not particularly limited, so long as a crosslinking reaction with a melamine resin can be elicited. The number-average molecular weight of the polyester is not particularly limited, but is preferably 5000 or higher, from the viewpoint of workability. Likewise, the hydroxyl value of the polyester is not particularly limited, but is preferably 40 mgKOH/g or lower. The glass transition point of the polyester is not particularly limited, but lies preferably in the range of 0° C. to 70° C. The hardness of the ink-receiving layer may be insufficient if the glass transition point is lower than 0° C. On the other hand, workability may be impaired if the glass transition point exceeds 70° C.

The melamine resin is a cross-linking agent of polyesters. The melamine resin is not particularly limited, but is preferably a methylated melamine resin. Preferably, the amount of methoxy groups among the functional groups in the molecule of the methylated melamine resin is 80 mol % or higher. The melamine resin may be used as a methylated melamine resin singly, or concomitantly with other melamine resins. The compounding amount of the melamine resin is preferably polyester:melamine resin=about 70:30 (mass ratio).

The catalyst promotes the reaction of the melamine resin. Examples of the catalyst include for instance dodecylbenzenesulfonic acid, p-toluenesulfonic acid and benzenesulfonic acid. The compounding amount of the catalyst is preferably about 0.1% to 8% with respect to resin solids.

The amine neutralizes the catalytic reaction. Examples of the amine include for instance triethylamine, dimethylethanolamine, dimethylaminoethanol, monoethanolamine and isopropanolamine. The compounding amount of the amine is not particularly limited, but is preferably 50% or more in equivalents with respect to the acid (catalyst).

In a case where the resin for forming the matrix is an acrylic resin, there is used for instance an acrylic resin emulsion. The molecular weight of the acrylic resin in the emulsion lies preferably in the range of 200,000 to 2,000,000. The molecular weight of the acrylic resin in the emulsion can be measured by gel permeation chromatography (GPC).

In the case of polyvinylidene fluoride as the resin for forming a matrix, there can be used for instance a coating material in the form of a resin composition resulting from mixing a thermoplastic acrylic resin, in a ratio by weight of 20/80 to 50/50, with polyvinylidene fluoride.

An extender pigment (also including beads) or a color pigment may be used as a pigment utilized in the ink-receiving layer.

The type of the extender pigment is not particularly limited. Examples of extender pigments include for instance silica, calcium carbonate, barium sulfate, aluminum hydroxide, talc, mica, resin beads and glass beads.

The type of the resin beads is not particularly limited. Examples of resin beads include for instance acrylic resin beads, polyacrylonitrile beads, polyethylene beads, polypropylene beads, polyester beads, urethane resin beads and epoxy resin beads. These resin beads may be produced in accordance with known methods, or may be sourced as commercially available products. Examples of commercially available acrylic resin beads include for instance "TAFTIC AR650S (average particle size 18 μm)", "TAFTIC AR650M (average particle size 30 μm)", "TAFTIC AR650MX (average particle size 40 μm)", "TAFTIC AR650MZ (average particle size 60 μm)", "TAFTIC AR650ML (average particle size 80 μm)", "TAFTIC AR650L (average particle size 100 μm)" and "TAFTIC AR650LL (average particle size 150 μm)" by Toyobo Co., Ltd. Examples of commercially available polyacrylonitrile beads include for instance "TAFTIC A-20 (average particle size 24 μm)", "TAFTIC YK-30 (average particle size 33 μm)", "TAFTIC YK-50 (average particle size 50 μm)" and "TAFTIC YK-80 (average particle size 80 μm)" by Toyobo Co., Ltd.

The type of the color pigment is not particularly limited. Examples of color pigments include for instance carbon black, titanium oxide, iron oxide, yellow iron oxide, phthalocyanine blue and cobalt blue.

The type and particle size of the pigments and the content of the pigments in the resin composition (coating material) can be adjusted as appropriate by a person skilled in the art depending on the type of printing and the type of ink to be printed.

The thickness of the ink-receiving layer is not particularly limited, but lies ordinarily in the range of 3 to 30 μm. If the coating film is too thin the durability and the hiding properties of the coating film may be insufficient. If the coating film is excessively thick, on the other hand, production costs increase and solvent popping may be likelier to occur during baking.

Thermal conductivity in the present invention can be measured in accordance with the method of JIS R1611-2010 (corresponding international standard: ISO 18755:2005). Specifically, a 10 $mm^2$ sample is prepared, wherein thermal conductivity be measured using a thermophysical property measuring device LFA-502 according to a laser flash method, by Kyoto Electronics Manufacturing Co., Ltd.

Among the metal substrates of the present invention, plated steel sheets such as a hot-dip Zn-55% Al alloy plated steel sheets, and stainless steel sheets, aluminum sheets, copper sheets as well as degreased ordinary steel sheets, none of which has the surface covered with a resin, are preferably subjected to preheating and a flame treatment several hours prior to being coated or printed. Specifically, preheating and the flame treatment are carried out preferably within 4 hours, more preferably within 2 hours, yet more preferably within 30 minutes, and most preferably within 10 minutes, of coating or printing of the metal substrate.

When the time elapsed until coating or printing exceeds 4 hours after the treatment, foreign matter such as dust or dirt deposits again on the substrate surface, and the effect of the pretreatment method of the present invention cannot be sufficiently brought out. Dirt is less likely to adhere to a metal substrate in which a coated steel sheet or the like is covered with a resin than in the case of a metal substrate not covered with a resin. Accordingly, the flame treatment effect can be maintained for several months (for instance about 6 months). Therefore, the coated steel sheet may be treated after several months have elapsed since the flame treatment. The coated steel sheet may be treated within a time window similar to those of the above steel sheets, after the flame treatment.

The treatment method prior to coating or printing of the metal substrate surface of the present invention involves preheating the substrate to 40° C. or above. The method for preheating the substrate is not particularly limited. For instance, a heating device generally referred to as a drying furnace can be used. Specifically, a batch-type drying furnace (also referred to as "safe furnace") can be used. For instance a low temperature incubator (model Mini Katarina MRLV-11, by Isuzu Seisakusho Co., Ltd.) or an automatic discharge-type dryer (model ATO-101, by Tojo Netsugaku Co., Ltd.) can be used herein.

The preheating temperature in the present invention denotes the temperature immediately before the flame treatment, which is not necessarily identical to the temperature immediately after preheating. In other words, the present invention includes a step of performing a flame treatment on a metal substrate having a temperature of 40° C. or above as a result of preheating. Specifically, the preheating temperature denotes a temperature measured within 3 seconds, preferably within 1 second and more preferably within 0.5 second, before the flame treatment.

Preferably, preheating is carried out at a higher temperature, since doing so allows reducing flame treatment variability. Specifically, preheating is carried out at 45° C. or above, more preferably at 50° C. or above, yet more preferably at 55° C. or above and even yet more preferably at 60° C. or above. Preferably, the temperature of preheating is set to be increasingly higher the higher the thermal conductivity of the metal substrate is. In the case for instance of a substrate having a thermal conductivity of 100 W/mK or higher, preheating is preferably carried out at 60° C. or above, and more preferably at 65° C. or above.

The upper limit of the preheating temperature is not particularly limited. The metal substrate is preferably preheated in such a manner that the temperature of the metal substrate does not exceed 300° C., from the viewpoint of degradation caused by oxidation of the surface of the metal substrate. Accordingly, the upper limit of the preheating temperature is preferably set to below 300° C.

A gas burner is used in the flame treatment of the present invention. Gas burners that are utilized generally for surface treatments of steel sheets and coated steel sheets can be used herein as the gas burner.

The number of gas burners used in the flame treatment is not particularly limited, so long as the desired effect can be elicited, but preferably one or two gas burners are used in the flame treatment of the present invention. Using any more gas burners may result in excessive heating of the metal substrate, while one or two gas burners are sufficient in terms of incinerating dirt, dust and so forth on the substrate.

Fuel gases ordinarily used are for instance hydrogen, liquefied petroleum gas (LPG), liquefied natural gas (LNG), acetylene gas, propane gas, butane and the like. Air or oxygen is used as a combustion aid gas. Herein LPG or LNG is preferably used in terms of combustion energy.

The form of the flame ports is not particularly limited, but ordinarily there can be used gas burners of ribbon type or round hole type.

Burners having a burner head with such a structure are commercially available. For instance, a product named F-3000 by Flynn Burner Corporation (USA), or a product named FFP250 by Finecom I & T Corp. (Korea) can be used.

The width of the flame ports of the burner (breadth parallel to the width direction of the substrate) must be of a magnitude such that the flames are irradiated over the entire surface of the substrate, and thus an appropriate burner is selected depending on the breadth of the substrate in the width direction. For instance a burner having a flame port width of 45 to 50 cm is selected in a case where the breadth of the substrate in the width direction is 40 cm.

The output of the burner is adjusted so as to enable the flames to incinerate dust and dirt (foreign matter) on the substrate surface. For instance, the output of the burner is adjusted to an output of 250 kJ/hour to 12000 kJ/hour, preferably 400 kJ/hour to 7500 kJ/hour, yet more preferably 600 kJ/hour to 5000 kJ/hour, and even yet more preferably 1200 kJ/hour to 5000 kJ/hour, per 10 mm of flame port width of the burner.

Coating of the substrate that is utilized in the present invention is accomplished by applying a coating material (optionally containing a pigment) similar to that of the resin composition that is utilized in the above ink-receiving layer. Any known method such as a roll coater method or a bar coater method can be resorted to herein as the coating method.

Any known printing method can be utilized for printing on the substrate that is used in the present invention. Examples of printing methods include gravure printing, offset printing, screen printing and inkjet printing. Among the foregoing inkjet printing is a preferred printing method since it allows forming easily complex multicolor patterns in a short time.

A known ink can be used as the ink utilized for inkjet printing. Specific examples thereof include for instance water-based inks, oil-based inks and actinic-ray curable inks. An actinic-ray curable ink is preferably used herein since in that case the effect of the present invention is more prominent. Actinic-ray curable inks include radical polymerization-type inks and cationic polymerization-type inks, both of which can be used herein.

Actinic-ray curable inks ordinarily include a monomer or oligomer, a photopolymerization initiator, a colorant, a dispersant, a surfactant and other additives. Materials ordinarily used in the relevant technical field are utilized in the present invention. Cationic polymerization-type inks are particularly preferred herein in that they exhibit a volume shrinkage factor lower than that of radical polymerization-type inks, and afford high adhesion also for a non-permeable ink-receiving layer of increased crosslinking density.

The term "actinic ray" in the present invention denotes for instance electron beams, ultraviolet rays, α-rays, γ-rays, X-rays and the like. Electron beams and ultraviolet rays are preferably used, and most preferably ultraviolet rays are used, in the present invention from the viewpoint of safety and handleability.

After having landed on the printing surface of the substrate, the actinic-ray curable ink is cured by actinic rays from an actinic ray irradiation machine. The actinic rays are ordinarily irradiated after 1.0 seconds or more, preferably 2.0 seconds or more, yet more preferably 2.2 seconds or more have elapsed since landing of the ink droplets. Polymerization of the ink is hindered by moisture in air, and accordingly the actinic rays are irradiated within 30 seconds after landing of the ink.

An embodiment of the treatment method of the present invention will be explained next. In FIG. 1 the reference symbol 1 represents a metal substrate (hereafter also referred to as "substrate 1"), 2 represents a gas burner, 3 represents an inkjet printing machine, 4 represents an actinic ray irradiation machine and 5 represents a transport machine.

Specifically, the substrate 1 having been preheated to 40° C. or above in a batch-type drying furnace is first placed on the transport machine 5. The substrate 1 placed on the transport machine 5 is transported in the direction of the broken line arrow, and is subjected to a flame treatment by flames of the gas burner 2. The substrate surface is then printed, by the inkjet printing machine, after the flame treatment. In the case of inkjet printing using an actinic-ray curable ink, the ink is cured through irradiation of actinic rays by the actinic ray irradiation machine 4.

The transport speed of the substrate 1 by the transport machine 5 varies depending for instance on the printing conditions, but is generally 10 m/min to 50 m/min, preferably 20 m/min to 40 m/min.

The lapse of time from the preheating treatment up to the flame treatment must lie within a time range that allows for a flame treatment in which the temperature of the substrate after preheating is 40° C. or higher; herein, this lapse of time can be established by fitting a thermometer to the substrate and by carrying out a preliminary test. For instance the lapse of time can be established by creating beforehand a temperature attenuation curve of the substrate. The speed of the transport machine 5 and the installation positions of the gas burners can then be decided on the basis of the time thus determined.

Examples

The present invention will be explained in more specific terms below by way of examples and test examples. However, the invention is not meant to be limited by these examples.

An austenitic stainless steel sheet, a coated steel sheet, a ferritic stainless steel sheet, a hot-dip Zn-55% Al alloy plated steel sheet and an aluminum alloy sheet were used as a metal substrate, and an acrylic sheet was used as a reference substrate.

1. Preparation of Various Substrates (1) Austenitic stainless steel sheet

A sheet of 0.5 mm thick SUS 304 BA, by Nisshin Steel Co., Ltd. was cut to A4 size.

(2) Coated steel sheet

Herein there was used a hot-dip Zn-55% Al alloy plated steel sheet, 0.5 mm thick and having a plating deposition amount of 90 g/m$^2$ per side of A4 size. The plated steel sheet was alkali-degreased, and was thereafter coated, using a roll coater, with coating-type chromate (NRC300NS: Nippon Paint Co., Ltd., deposition amount of 50 mg/m$^2$ in terms of Cr) and with a commercially available epoxy resin-based primer coating material (700P by Nippon Fine Coatings Inc.), as a primer layer, to a dry film thickness of 5 μm, followed by baking to a highest reached sheet temperature of 215° C.

The details of the coating material being the resin composition for forming an ink-receiving layer are as follows. A polymer polyester resin (by Nippon Fine Coatings Inc.) having a number-average molecular weight of 5,000, a glass transition temperature of 30° C. and a hydroxyl value of 28 mgKOH/g, was used as the resin. Methylated melamine resin (CYMEL 303, by Mitsui Cytec Ltd.) having 90 mol % of methoxy groups was used as a melamine resin being a cross-linking agent. The compounding ratio of the polyester resin and the melamine resin was 70/30. There were further added, as a color pigment, 49 mass % of titanium oxide (JR-603 by Tayca Corporation) having an average particle size of 0.28 μm, and also 13 mass % of mica (SJ-010 by Yamaguchi Mica Co., Ltd.) having an average particle size of 10 μm, 6 mass % of hydrophobic silica (Sylysia 456, by Fuji Silysia Chemical Ltd.) having an average particle size of 5.5 μm and 2 mass % of hydrophobic silica (Sylysia 476, by Fuji Silysia Chemical Ltd.) having an average particle size of 12 μm. As the catalyst there was added 1 mass % of dodecylbenzenesulfonic acid with respect to resin solids. As the amine there was added dimethylaminoethanol in an amine equivalent amount of 1.25 times the acid equivalent of dodecylbenzenesulfonic acid. After application using a roll coater to yield a dry thickness of 18 μm of the coating material, the whole was baked to a highest reached sheet temperature of 225° C.

(3) Ferritic Stainless Steel Sheet

A sheet of 0.5 mm thick SUS 430 BA by Nisshin Steel Co., Ltd., cut to A4 size, was used herein.

(4) Hot-Dip Zn-55% Al Alloy Plated Steel Sheet

Herein there was used a hot-dip Zn-55% Al alloy plated steel sheet, 0.5 mm thick and having a plating deposition amount of 90 g/m$^2$ per side, by Nisshin Steel Co., Ltd., cut to A4 size.

(5) Aluminum Alloy Sheet

Herein there was used a 0.5 mm thick JIS 5052 aluminum alloy sheet by Mitsubishi Aluminum Co., Ltd., cut to A4 size.

(6) Acrylic Sheet (Reference Example)

Herein there was used a 2.0 mm thick acrylic sheet (trade name Acrylite S) by Mitsubishi Rayon Co., Ltd., cut to A4 size.

2. Measurement of Thermal Conductivity

The thermal conductivity of the various substrates was measured in accordance with the method in JIS R1611-2010 (corresponding international standard: ISO 18755:2005). Specifically, respective 10 mm$^2$ samples were prepared and thermal conductivity was measured using a thermophysical property measuring device LFA-502 according to a laser flash method, by Kyoto Electronics Manufacturing Co., Ltd.

3. Preheating Method of the Various Substrates

In a case where the temperature of the substrates was set to 20° C. or 40° C., each substrate was placed for 5 minutes in a low temperature incubator (model Mini Katarina MRLV-11, by Isuzu Seisakusho Co., Ltd.), was thereafter set on a transport machine, and was subjected to a flame treatment.

In a case where the temperature of the substrates was set to 50° C. or 60° C., each substrate was subjected to a thermal treatment for 5 minutes, with an air flow set to 2.0 m/s, using an automatic discharge-type dryer (model ATO-101, by Tojo Netsugaku Co., Ltd.), was thereafter set on the transport machine, and was subjected to a flame treatment The speed of the transport machine at that time was 15 m/min.

4. Measurement of the Temperature of the Various Substrates

Herein there was measured the temperature of each substrate immediately before (0.2 second before) the flame treatment.

A thermocouple thermometer (K type) (temperature logger LR5021, by Hioki E.E. Corporation) and a sensor (tape-type multi-purpose temperature sensor by Anritsu Meter Co., Ltd.) were attached to the surface of each substrate, to measure the temperature.

5. Flame Treatment Method of the Various Substrates

A gas burner, in this case FFP200 by Finecom I & T Corp. (Korea) was used as the flame treatment device. Herein LP gas was used as the combustion gas, with 0.4 L/min of LP gas and 10 L/min of clean dry air being mixed, using a gas mixer, for each 10 mm width of flame ports of the burner. A flame treatment was performed thereafter through burning by the burner. The distance between the flame head and the substrate was set to 30 mm.

6. Inkjet Printing Using an Actinic-Ray Curable Ink

Inkjet printing was carried out, using an actinic ray curable inkjet ink, about two minutes after the flame treatment.

A radical polymerization-type ultraviolet curable black ink and a cationic polymerization-type ultraviolet curable black ink were used as an actinic-ray curable ink. The specific composition of each ink is as follows.

(i) Radical Polymerization-Type Ultraviolet Curable Black Ink

The radical polymerization-type ultraviolet curable black ink was prepared by mixing the components below. The specific composition is as follows.

Pigment dispersion[1)] (pigment content: 10 mass %) 10 parts by mass

Reactive oligomer[2)] 25 parts by mass

Reactive oligomer[3)] 57 parts by mass

Photopolymerization initiator[4)] 5 parts by mass

Photopolymerization initiator[5)] 3 parts by mass

1) Pigment: NIPex 35, carbon, Degussa Japan Co., Ltd., dispersion medium: SR9003, PO-modified neopentyl glycol diacrylate, Sartomer Japan Inc.

2) CN985B88, mixture of 88 mass % of bifunctional aliphatic urethane acrylate and 12 mass % of 1,6-hexanediol diacrylate, Sartomer Japan Inc.

3) 1,6-hexanediol diacrylate

4) IRGACURE 184, hydroxyketone, Ciba Japan Co., Ltd.

5) IRGACURE 819, acylphosphine oxide, Ciba Japan Co., Ltd.

(ii) Cationic Polymerization-Type Ultraviolet Curable Ink

Herein 20 parts by mass of black: Pigment Black 7 were added to 9 parts by mass of a polymer dispersant (PB821 by Ajinomoto Fine-Techno Co., Inc.) and 71 parts by mass of an oxetane compound (OXT211 by Toagosei Co., Ltd.); the whole was charged and sealed into a glass bottle together with 200 g of zirconia beads having a diameter of 1 mm, and then a dispersion treatment was carried out for 4 hours in a paint shaker. Thereafter, the zirconia beads were removed, to prepare a black pigment dispersion.

Then the photopolymerizable compounds, basic compound, surfactants, compatibilizer and photoacid generator below were mixed with 14 parts by mass of the above dispersion, to produce a cationic polymerization-type ultraviolet curable inkjet ink.

TABLE 1

| Component | Compounding amount |
|---|---|
| Photopolymerizable compound | |
| Epoxidized linseed oil Vikoflex 9040 (by ATOFINA) | 4 parts by mass |
| EP-1 structural formula, see Japanese Patent No. 4539104 | 34 parts by mass |
| Oxetane compound OXT-221 (by Toagosei Co., Ltd.) | 24 parts by mass |
| Oxetane compound OXT-211 (by Toagosei Co., Ltd.) | 8.9 parts by mass |
| Basic compound | |
| N-ethyldiethanolamine | 0.05 parts by mass |
| Surfactant | |
| MEGAFAC F178k (perfluoroalkyl group-containing acrylic oligomer (by Dainippon Ink and Chemicals)) | 0.025 parts by mass |
| MEGAFAC F1405 (perfluoroalkyl group-containing ethylene oxide adduct (by Nippon Fine Coatings Inc.) | 0.025 parts by mass |
| Compatibilizer | |
| Hisolve BDB (glycol ether by Toho Chemical Industry Co., Ltd.) | 10 parts by mass |
| Photoacid generator | |
| UV16992 (by The Dow Chemical Company) | 5 parts by mass |

Inkjet printing conditions of the radical polymerization-type ultraviolet curable ink (a) nozzle diameter: 35 μm (b) applied voltage: 11.5 V (c) pulse width: 10.0 μs (d) driving frequency: 3,483 Hz (e) resolution: 360 dpi (f) ink droplet volume: 42 pl (g) head heating temperature: 45° C.

(h) ink coating amount: 8.4 g/m$^2$ (i) distance between head and recording surface: 5.0 mm (j) initial velocity of ink droplets: 5.9 m/sec Inkjet printing conditions of the cationic polymerization-type ultraviolet curable ink (a) nozzle diameter: 35 μm (b) applied voltage: 13.2 V (c) pulse width: 10.0 μs (d) driving frequency: 3,483 Hz (e) resolution: 360 dpi (f) ink droplet volume: 42 pl (g) head heating temperature: 45° C.

(h) ink coating amount: 8.4 g/m$^2$ (i) distance between head and recording surface: 5.0 mm (j) initial velocity of ink droplets: 6.1 m/sec Ultraviolet rays were used as the actinic rays in the examples. Ultraviolet curing of the inks after inkjet printing was performed under the conditions below. Ultraviolet irradiation was carried out after 5 seconds from landing of the ink droplets.

(1) Lamp type: high-pressure mercury lamp (H Valve, by Fusion UV Systems Japan Co., Ltd.)

(2) Lamp output: 200 W/cm (3) Integrated light quantity: 600 mJ/cm$^2$ (measured using an ultraviolet actinometer UV-351-25, by ORC Manufacturing Co., Ltd.)

7. Evaluation of Adhesion of the Ultraviolet Curable Ink to the Substrate

Herein 100% of the surface of the various substrates was printed (ink coating amount: 8.4 g/m$^2$) with the ultraviolet curable ink, to a resolution of 360 dpi. A cross-cut test according to JIS K5600-5-6 G 330 (corresponding to ISO 2409) was performed on the printed material. Specifically, cuts were made on the surface of the printed material in the form of a grid pattern with 100 squares at a pitch of 1 mm, and tape was affixed to the portion with the cuts. The tape was stripped off, and the survival rate of the coating film was observed. Instances where the stripped surface area of the coating film was 0% were rated as good "○", instances where the stripped surface area was greater than 0% up to 20% were rated as fair "Δ", and instances where the stripped surface area exceeded 20% were rated as poor "X". A rating of Δ or better was deemed acceptable herein.

8. Evaluation of Water Wettability

The water contact angle of each substrate after the flame treatment was measured, under the conditions below, using a portable contact angle meter PCA-1, by Kyowa Interface Science Co., Ltd.

Measurement Conditions of Water Contact Angle

Droplet volume: 1.0 μl

Wait time from droplet landing until measurement: 3 seconds

Analysis method of water contact angle: θ/2 method

A water contact angle of less than 10 degrees was rated as excellent "⊗", from 10 to 19 degrees was rated as good "○", from 20 to 29 degrees was rated as fair "Δ", and an angle of 30 degrees or greater was rated as poor "X". A rating of Δ or better was deemed acceptable herein.

TABLE 2

| | Substrate type | Thermal conductivity of substrate W/mK | Substrate temperature immediately before flame treatment (° C.) | Water wettability and ink adhesion after flame treatment: Water wettability: Contact angle (° C.) | Water wettability: Evaluation | Evaluation of cross-cut adhesion: Radical polymerization-type ink | Evaluation of cross-cut adhesion: Cationic polymerization-type ink |
|---|---|---|---|---|---|---|---|
| Invention ex. 1-1 | Austenitic stainless steel sheet | 17 | 40 | 12 | ○ | ○ | ○ |
| Invention ex. 1-2 | | | 50 | 8 | ⊗ | ○ | ○ |
| Invention ex. 1-3 | | | 60 | 7 | ⊗ | ○ | ○ |
| Invention ex. 1-4 | | | 70 | 7 | ⊗ | ○ | ○ |
| Invention ex. 2-1 | Coated steel sheet | 44 | 40 | 19 | ○ | Δ | ○ |
| Invention ex. 2-2 | | | 50 | 9 | ⊗ | ○ | ○ |
| Invention ex. 2-3 | | | 60 | 7 | ⊗ | ○ | ○ |
| Invention ex. 2-4 | | | 70 | 7 | ⊗ | ○ | ○ |
| Invention ex. 3-1 | Ferritic stainless steel sheet | 45 | 40 | 20 | Δ | Δ | Δ |
| Invention ex. 3-2 | | | 50 | 9 | ⊗ | ○ | ○ |
| Invention ex. 3-3 | | | 60 | 7 | ⊗ | ○ | ○ |
| Invention ex. 3-4 | | | 70 | 7 | ⊗ | ○ | ○ |
| Invention ex. 4-1 | Hot-dip Zn-55% Al alloy plated steel sheet | 53 | 40 | 22 | Δ | Δ | Δ |
| Invention ex. 4-2 | | | 50 | 13 | ○ | ○ | ○ |
| Invention ex. 4-3 | | | 60 | 7 | ⊗ | ○ | ○ |
| Invention ex. 4-4 | | | 70 | 7 | ⊗ | ○ | ○ |
| Invention ex. 5-1 | Aluminum alloy sheet | 210 | 40 | 29 | Δ | Δ | Δ |
| Invention ex. 5-2 | | | 50 | 21 | Δ | Δ | Δ |
| Invention ex. 5-3 | | | 60 | 9 | ⊗ | ○ | ○ |
| Invention ex. 5-4 | | | 70 | 8 | ⊗ | ○ | ○ |
| Ref. ex. 1 | Acrylic sheet | 0.2 | 20 | 6 | ⊗ | ○ | ○ |
| Comp. ex. 1 | Austenitic stainless steel sheet | 17 | 20 | 33 | x | x | x |
| Comp. ex. 2 | Coated steel sheet | 44 | 20 | 46 | x | x | x |
| Comp. ex. 3 | Ferritic stainless steel sheet | 45 | 20 | 44 | x | x | x |
| Comp. ex. 4 | Hot-dip Zn-55% Al alloy plated steel sheet | 53 | 20 | 37 | x | x | x |
| Comp. ex. 5 | Aluminum alloy sheet | 210 | 20 | 48 | x | x | x |

The tables reveal that in substrates of high thermal conductivity, wettability and adhesion of the printing ink after the flame treatment were poor in cases where the temperature immediately before the flame treatment of the substrate was lower than 40° C. The wettability and adhesion of the printing ink was not affected by the acrylic sheet even when the temperature immediately before the flame treatment was lower than 40° C.

REFERENCE SIGNS LIST

1 Substrate
2 Gas burner
3 Inkjet printing machine
4 Actinic ray irradiation machine
5 Transport machine

The invention claimed is:

1. A method for treating a coated steel sheet surface before forming patterns thereon by inkjet printing, the method comprising: preheating a coated steel sheet having a thermal conductivity of 10 W/mK or higher to 40° C. or above, and thereafter performing a flame treatment on the coated steel sheet surface, followed by inkjet printing of the coated steel sheet surface with an inkjet ink;

wherein a transport speed of the coated steel sheet is 10 m/min to 50 m/min.

2. The treatment method of claim 1, wherein the coated steel sheet is preheated to 50° C. or above.

3. The treatment method of claim 1, wherein the coated steel sheet is preheated to 60° C. or above.

4. The treatment method of claim 1, wherein preheating is carried out in such a manner that the temperature of the coated steel sheet does not exceed 300° C.

5. The treatment method of claim 1, wherein the coated steel sheet is subjected to the flame treatment using one or two gas burners.

6. The treatment method of claim 1, wherein the inkjet printing is carried out using an actinic-ray curable ink.

7. The treatment method of claim 1, wherein occurrence of condensation derived from the flame of a gas burner used in the flame treatment is suppressed.

8. A method for suppressing occurrence of condensation derived from the flame of a gas burner, the method comprising: bringing the temperature of a coated steel sheet during a flame treatment, which is performed by a gas burner prior to forming patterns on the coated steel sheet surface with an inkjet ink by inkjet printing, to 40° C. or above through preheating, wherein the coated steel sheet has a thermal conductivity of 10 W/mK or higher, wherein a transport speed of the coated steel sheet is 10 m/min to 50 m/min.

9. The treatment method of claim 1, wherein the patterns are multicolor.

* * * * *